US012575674B2

(12) United States Patent
Chen et al.

(10) Patent No.: US 12,575,674 B2
(45) Date of Patent: Mar. 17, 2026

(54) SLIDE RAIL ASSEMBLY

(71) Applicants: King Slide Works Co., Ltd., Kaohsiung City (TW); King Slide Technology Co., Ltd., Kaohsiung City (TW)

(72) Inventors: Ken-Ching Chen, Kaohsiung City (TW); Shun-Ho Yang, Kaohsiung City (TW); Kai-Wen Yu, Kaohsiung City (TW); Chun-Chiang Wang, Kaohsiung City (TW)

(73) Assignees: King Slide Works Co., Ltd., Kaohsiung City (TW); King Slide Technology Co., Ltd., Kaohsiung City (TW)

( * ) Notice: Subject to any disclaimer, the term of this patent is extended or adjusted under 35 U.S.C. 154(b) by 181 days.

(21) Appl. No.: 18/680,028

(22) Filed: May 31, 2024

(65) Prior Publication Data

US 2025/0151900 A1 May 15, 2025

(30) Foreign Application Priority Data

Nov. 9, 2023 (TW) ..... 112143583

(51) Int. Cl.
*A47B 88/49* (2017.01)
*A47B 88/443* (2017.01)
*A47B 88/473* (2017.01)

(52) U.S. Cl.
CPC ..... *A47B 88/49* (2017.01); *A47B 88/443* (2017.01); *A47B 88/473* (2017.01)

(58) Field of Classification Search
CPC ..... A47B 88/49; A47B 88/473; A47B 88/443; A47B 88/477
USPC ..... 312/334.32
See application file for complete search history.

(56) References Cited

U.S. PATENT DOCUMENTS

| | | | |
|---|---|---|---|
| 10,398,228 | B2 | 9/2019 | Chen et al. |
| 10,617,208 | B2 | 4/2020 | Chen et al. |
| 10,781,855 | B2 | 9/2020 | Chen et al. |
| 2004/0174100 | A1 | 9/2004 | Chen et al. |

FOREIGN PATENT DOCUMENTS

| | | | |
|---|---|---|---|
| AT | 410507 | B | 5/2003 |
| JP | S63-157347 | U | 10/1988 |
| TW | 201836524 | A | 10/2018 |

*Primary Examiner* — Daniel J Troy
*Assistant Examiner* — Timothy M Ayres
(74) *Attorney, Agent, or Firm* — Best & Flanagan LLP

(57) ABSTRACT

A slide rail assembly includes a first rail, a second rail, a damping device and an auxiliary member. The first rail is arranged with a predetermined feature. The second rail is movable relative to the first rail. The damping device is arranged on the first rail. The auxiliary member is arranged on the second rail. During a process of the second rail being moved relative to the first rail along a direction, the auxiliary member is configured to abut against the damping device such that the damping device provides damping effect. When the second rail is further moved relative to the first rail along the direction, the predetermined feature is configured to abut against the auxiliary member to drive the auxiliary member to be detached from the damping device.

20 Claims, 10 Drawing Sheets

SLIDE RAIL ASSEMBLY

BACKGROUND OF THE INVENTION

1. Field of the Invention

The present invention relates to a slide rail assembly, and more particularly, to a slide rail assembly having damping effect when one slide rail is moved a predetermined distance relative to another slide rail.

2. Description of the Prior Art

U.S. Pat. No. 10,398,228B2 discloses a three-section slide rail assembly comprising a first rail, a second rail, a third rail and a damping device. The third rail (such as a middle rail) is movably mounted between the first rail (such as an outer rail) and the second rail (such as an inner rail). The damping device is mounted on the first rail. The third rail comprises a first pushing feature and a second pushing feature respectively located at two sides of the damping device. When the third rail is moved relative to the first rail along a first direction to be opened or along a second direction to be retracted, the damping device is capable of providing damping effect for two-way damping function.

U.S. Pat. No. 10,781,855B2 (hereinafter referred to as patent '855) discloses a slide rail assembly comprising a first rail (such as a middle rail), a ball bearing assembly, a second rail (such as an inner rail) and a damping device. The ball bearing assembly is movably mounted on the first rail. The ball bearing assembly comprises a ball retainer and a plurality of balls. The ball retainer comprises a stopping feature. The damping device is mounted on the first rail. The damping device corresponds to the stopping feature of the ball retainer is configured to provide a damping force. The ball retainer is configured to be driven to move by the second rail, such that the stopping feature of the ball retainer contacts the damping device. The slide rail assembly further comprises a third rail (such as an outer rail), and the first rail is movable relative to the third rail. The second rail (such as the inner rail) disclosed by patent '855 is configured to drive the ball retainer to move to abut against the damping device for providing damping effect.

The aforementioned patents disclose slide rail assemblies arranged with damping devices for providing damping effect. However, for different market requirements, it is important to develop various slide rail products.

SUMMARY OF THE INVENTION

The present invention provides a slide rail assembly having damping effect when one slide rail is moved a predetermined distance relative to another slide rail.

According to an embodiment of the present invention, a slide rail assembly comprises a first rail, a second rail, a damping device and an auxiliary member. The first rail is arranged with a predetermined feature. The second rail is movable relative to the first rail. The damping device is arranged on the first rail. The auxiliary member is arranged on the second rail and configured to switch between a first predetermined state and a second predetermined state relative to the second rail. During a process of the second rail being moved relative to the first rail along a first direction, the auxiliary member in the first predetermined state is configured to abut against the damping device, such that the damping device provides damping effect to the second rail; and when the second rail is further moved relative to the first rail along the first direction, the predetermined feature is configured to abut against the auxiliary member to drive the auxiliary member to switch from the first predetermined state to the second predetermined state in order to detach the auxiliary member from the damping device, such that the damping device no longer provides damping effect to the second rail.

According to another embodiment of the present invention, a slide rail assembly comprises a first rail, a second rail, a damping device, a predetermined feature and an auxiliary member. The second rail is movable relative to the first rail. The damping device and the predetermined feature are arranged on one of the first rail and the second rail. The auxiliary member is arranged on the other one of the first rail and the second rail, and the auxiliary member is an elastic component. During a process of the second rail being moved relative to the first rail along an opening direction, the auxiliary member is configured to abut against the damping device to drive the damping device to provide damping effect; and when the second rail is further moved relative to the first rail along the opening direction, the predetermined feature is configured to abut against the auxiliary member to elastically deform the auxiliary member to be detached from the damping device to no longer drive the damping device to provide damping effect.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
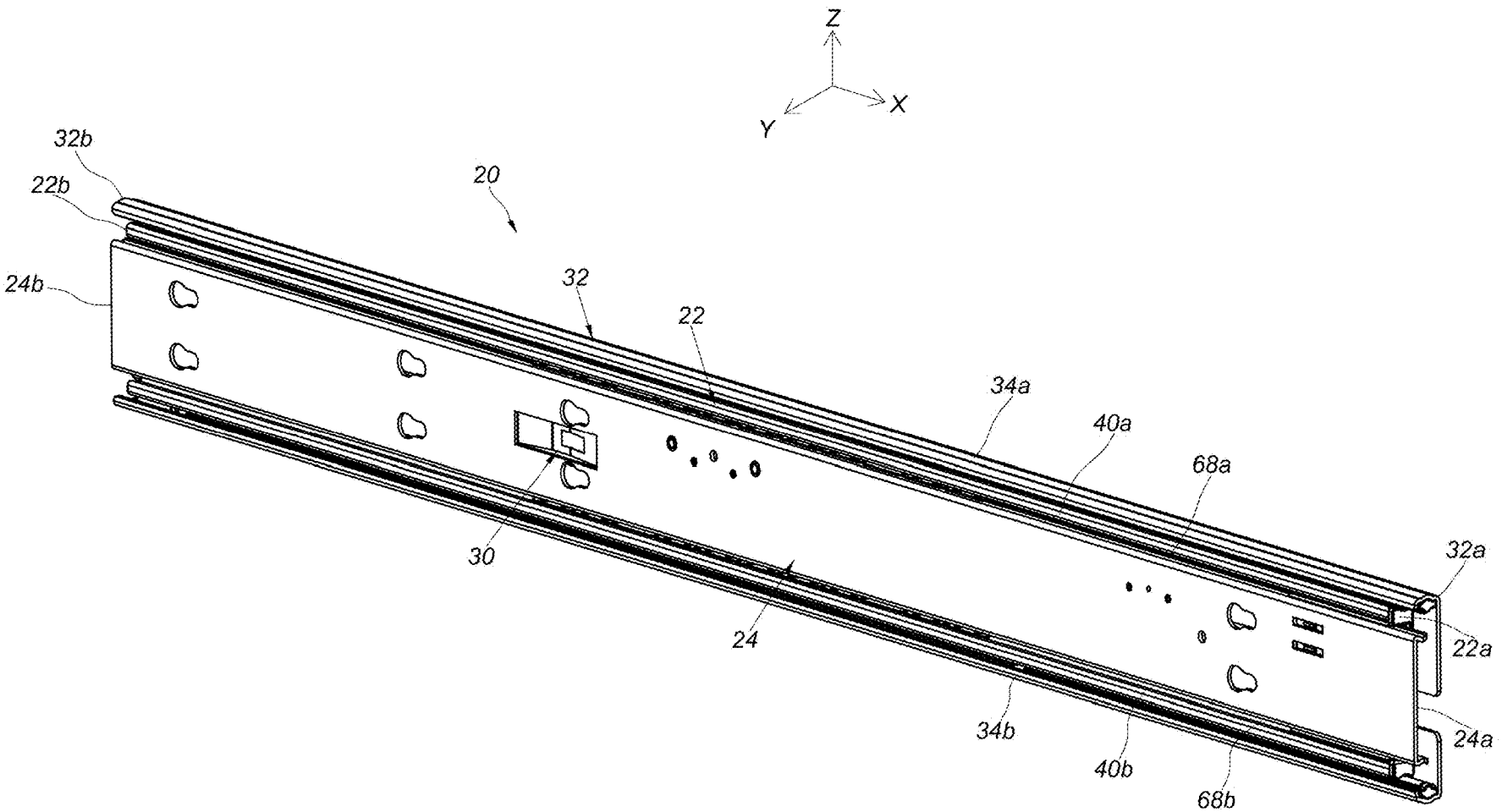
FIG. 1 is a diagram showing a slide rail assembly according to an embodiment of the present invention.
Figure 2:
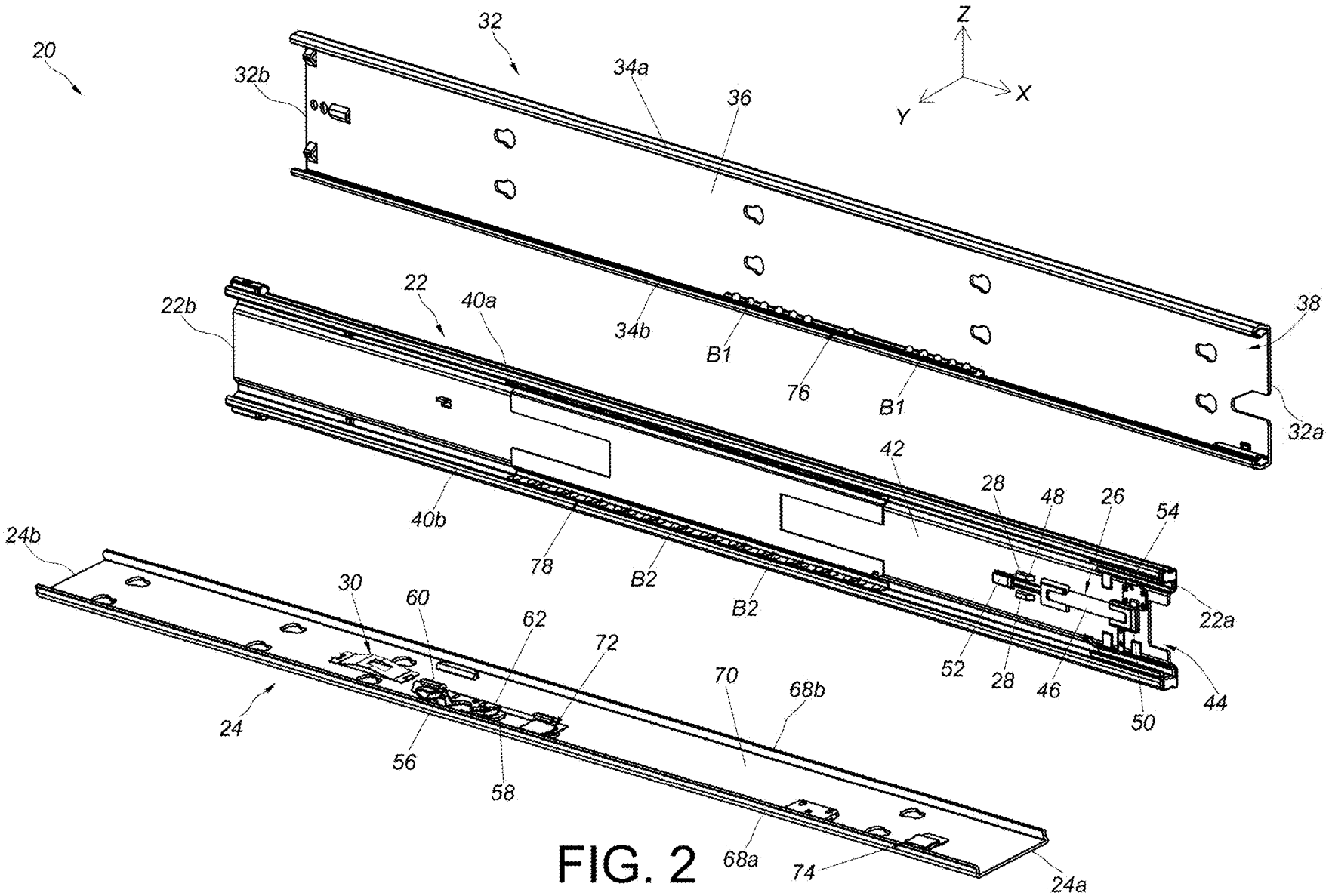
FIG. 2 is an exploded view of the slide rail assembly comprising a first rail, a second rail and a third rail according to the embodiment of the present invention.

As shown in FIG. 1 and FIG. 2, a slide rail assembly 20 comprises a first rail 22, a second rail 24, a damping device 26, at least one predetermined feature 28 and an auxiliary member 30 according to an embodiment of the present invention. The second rail 24 is longitudinally movable relative to the first rail 22. In the figures, the X axis is a longitudinal direction (or a length direction or a moving direction of the slide rail), the Y axis is a transverse direction (or a lateral direction of the slide rail), and the Z axis is a vertical direction (or a height direction of the slide rail). Preferably, the slide rail assembly 20 further comprises a third rail 32, and the first rail 22 is movably mounted between the third rail 32 and the second rail 24. In the present embodiment, the third rail 32 is an outer rail, the first rail 22 is a middle rail, and the second rail 24 is an inner rail, but the present invention is not limited thereto.

The damping device 26 and the at least one predetermined feature 28 are arranged on one of the first rail 22 and the second rail 24, and the auxiliary member 30 is arranged on the other one of the first rail 22 and the second rail 24. In the present embodiment, the damping device 26 and the at least one predetermined feature 28 are arranged on the first rail 22, and the auxiliary member 30 is arranged on the second rail 24.

The third rail 32 comprises a first wall 34*a*, a second wall 34*b* and a longitudinal wall 36 connected between the first wall 34*a* and the second wall 34*b* of the third rail 32. A passage 38 is defined by the first wall 34*a*, the second wall 34*b* and the longitudinal wall 36 of the third rail 32, and configured to accommodate the first rail 22. The third rail 32 has a first end part 32*a* and a second end part 32*b* (such as a front end part and a rear end part) opposite to each other.

The first rail 22 comprises a first wall 40*a*, a second wall 40*b* and a longitudinal wall 42 connected between the first wall 40*a* and the second wall 40*b* of the first rail 22. A passage 44 is defined by the first wall 40*a*, the second wall 40*b* and the longitudinal wall 42 of the first rail 22, and configured to accommodate the second rail 24.

Preferably, the first rail 22 has a first end part 22*a* and a second end part 22*b* (such as a front end part and a rear end part) opposite to each other. The damping device 26 is arranged adjacent to the first end part 22*a* of the first rail 22.

Preferably, the damping device 26 comprises a first damping part 46 and a second damping part 48 movable relative to each other. The first damping part 46 can be a cylinder body, and the second damping part 48 can be a rod body. The cylinder body contains a damping medium and/or an elastic member (such as a spring), and the rod body can be extended or retracted relative to the cylinder body. Such configuration is well known to those skilled in the art, no further illustration is provided for simplicity. In an alternative embodiment, the first damping part 46 can be a rod body, and the second damping part 48 can be a cylinder body.

Preferably, the first damping part 46 is fixed to the longitudinal wall 42 of the first rail 22 through at least one connecting base 50. The second damping part 48 is movable relative to the first damping part 46.

Preferably, one end of the second damping part 48 away from the first damping part 46 is arranged (fixedly connected with) an actuating member 52. The actuating member 52 and the second damping part 48 can be seen as one piece.

Preferably, the at least one predetermined feature 28 is a protrusion, and the slide rail assembly 20 can comprise one or more predetermined features 28. In the present embodiment, the slide rail assembly 20 comprises two predetermined features 28, but the present invention is not limited thereto. The predetermined features 28 are arranged on the longitudinal wall 42 of the first rail 22, and the predetermined features 28 are located between two ends (a first end 26*a* and a second end 26*b*, such as a front end and a rear end shown in FIG. 3) of the damping device 26. In the present embodiment, the predetermined features 28 are arranged adjacent to the second damping part 48 of the damping device 26. The predetermined features 28 and the second damping part 48 are located at different positions on the longitudinal wall 42 of the first rail 22 along the height direction of the slide rail.

Figure 3:
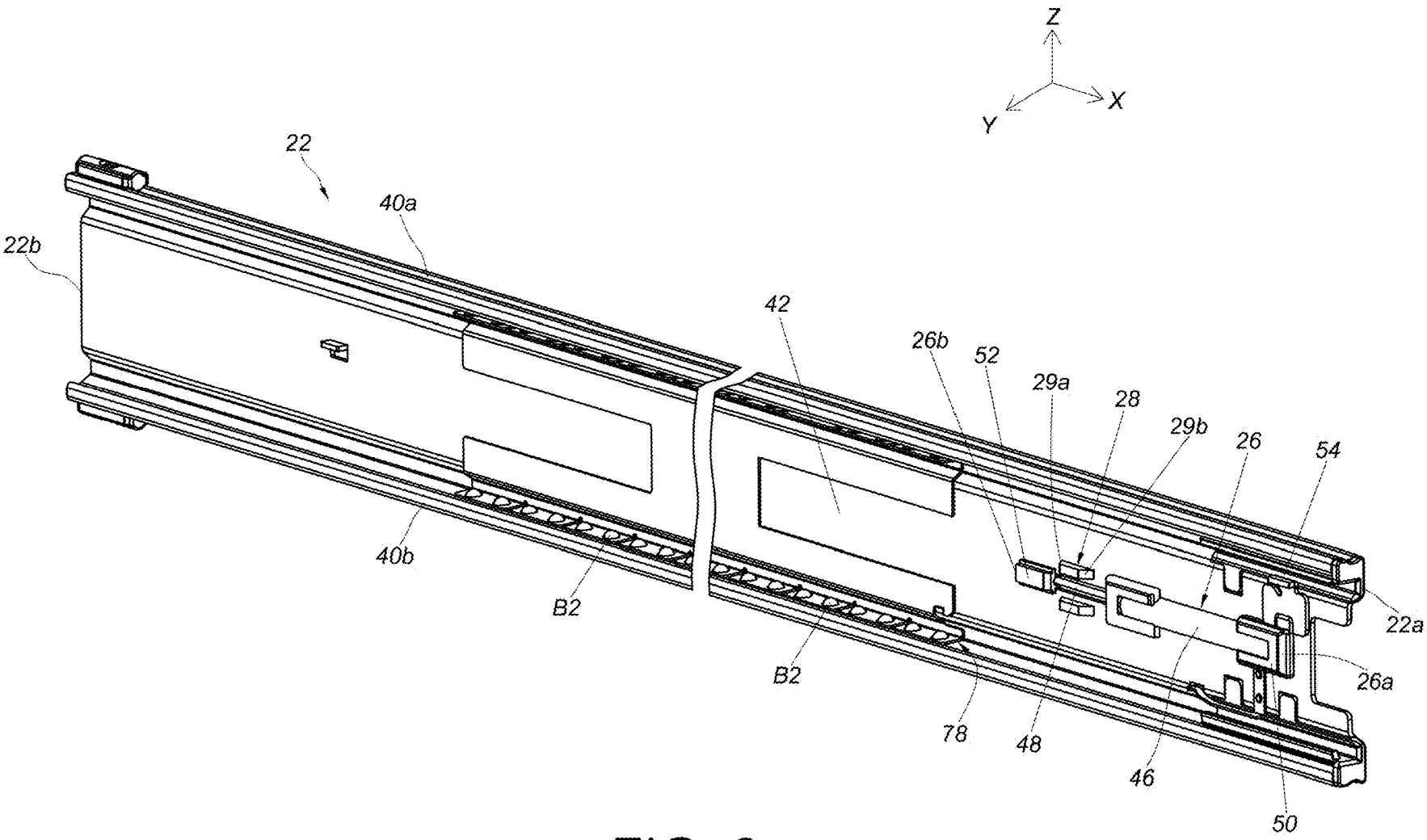
FIG. 3 is a diagram showing the first rail according to the embodiment of the present invention.

Preferably, the first rail 22 further comprises a blocking part 54 adjacent to the first end part 22*a* of the first rail 22 (please also refer to FIG. 3). The blocking part 54 is (transversally or laterally) protruded relative to the longitudinal wall 42 of the first rail 22, but the present invention is not limited thereto.

Figure 4:
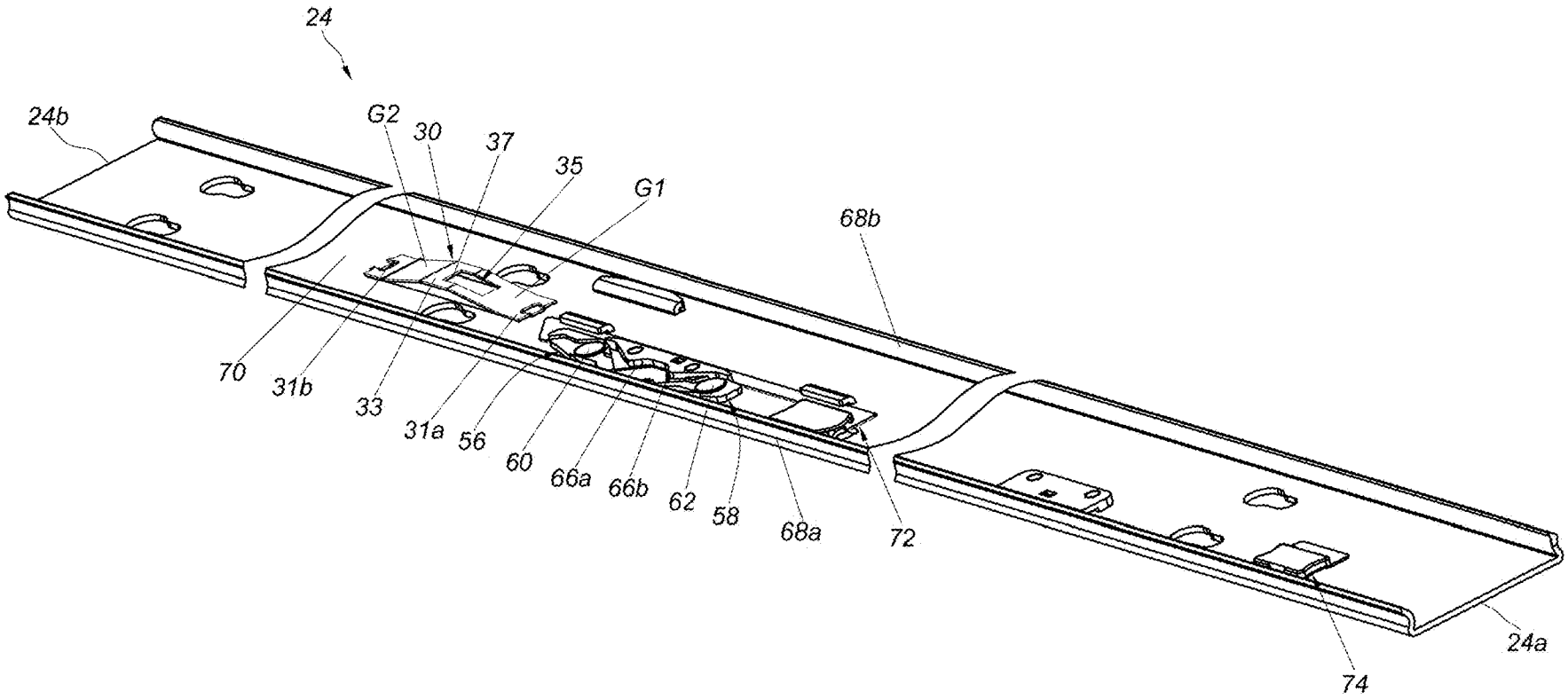
FIG. 4 is a diagram showing the second rail according to the embodiment of the present invention.

The second rail 24 has a first end part 24*a* and a second end part 24*b* (such as a front end part and a rear end part) opposite to each other. The slide rail assembly 20 further comprises a first working member 56 and/or a second working member 58 movably mounted on the second rail 24. In the present embodiment, the first working member 56 and the second working member 58 are pivoted to the second rail 24 through a first shaft member 60 and a second shaft member 62 respectively. The second rail 24 is arranged with an auxiliary elastic member. The auxiliary elastic member comprises a first elastic part 66*a* and a second elastic part 66*b* configured to provide elastic forces to the first working member 56 and the second working member 58 respectively (please also refer to FIG. 4 and FIG. 9).

Preferably, the second rail 24 comprises a first wall 68*a*, a second wall 68*b* and a longitudinal wall 70 connected between the first wall 68*a* and the second wall 68*b* of the second rail 24. The auxiliary member 30 is arranged on the longitudinal wall 70 of the second rail 24. Furthermore, the auxiliary member 30 is an elastic component, such as an elastic piece, but the present invention is not limited thereto. The auxiliary member 30 comprises a first connecting part 31*a*, a second connecting part 31*b* and a middle part 33 located between the first connecting part 31*a* and the second connecting part 31*b*. For example, the middle part 33 is extended between the first connecting part 31*a* and the second connecting part 31*b* (please also refer to FIG. 4). The first connecting portion 31*a* and the second connecting portion 31*b* are connected (such as fixed) to the longitudinal wall 70 of the second rail 24. The middle part 33 is transversally or laterally raised relative to the longitudinal wall 70 of the second rail 24. A space 35 (such as an opening, but the present invention is not limited thereto) is formed between the middle part 33 and the first connecting part 31*a*, and the middle part 33 is arranged with a predetermined wall 37 located at an edge of the space 35 (please also refer to FIG. 4).

Preferably, a first guiding section G1 is arranged between the middle part 33 and the first connecting part 31*a*, and a second guiding section G2 is arranged between the middle part 33 and the second connecting part 31*b*. The first guiding section G1 and the second guiding section G2 can be inclined surfaces or arc surfaces.

Preferably, the slide rail assembly 20 further comprises at least one operating member. In the present embodiment, the slide rail assembly 20 comprises a first operating member 72 and a second operating member 74 configured to respectively drive the first working member 56 and the second working member 58 to move. The first operating member 72 and the second operating member 74 are operatively connected to the first working member 56 and the second working member 58 respectively.

Preferably, the slide rail assembly 20 further comprises at least one first slide assisting device 76. The at least one first slide assisting device 76 comprises a plurality of first balls B1. The at least one first slide assisting device 76 is movably mounted in the passage 38 of the third rail 32 to improve moving smoothness between the first rail 22 and the third rail 32. On the other hand, the slide rail assembly 20 further comprises a second slide assisting device 78. The second slide assisting device 78 comprises a plurality of second balls B2. The second slide assisting device 78 is movably mounted in the passage 44 of the first rail 22 to improve moving smoothness between the second rail 24 and the first rail 22.

Figure 5:
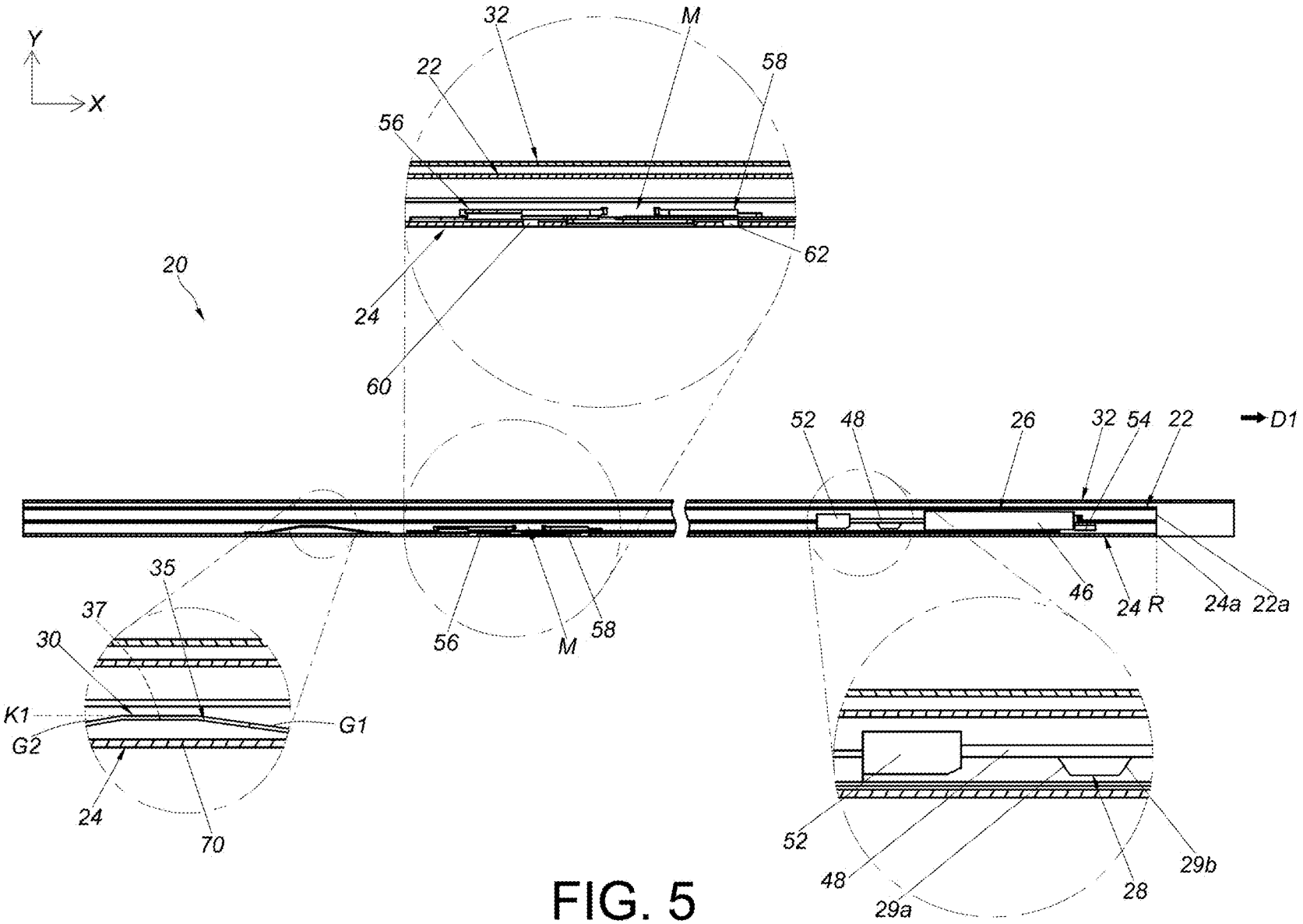
FIG. 5 is a diagram showing the slide rail assembly in a retracted state according to the embodiment of the present invention.

As shown in FIG. 5, the slide rail assembly 20 is in a retracted state. Furthermore, the first rail 22 is retracted relative to the third rail 32, and the second rail 24 is located at a retracted position R relative to the first rail 22. The auxiliary member 30 is separated from the damping device 26 along the longitudinal direction. The auxiliary member 30 is in a first predetermined state K1 relative to the second rail 24, and the damping device 26 is in a damping preparation state (for example, the second damping part 48 is extended relative to the first damping part 46). The first and second working members 56, 58 are separated from the blocking part 54 along the longitudinal direction. An auxiliary space M is defined between the first working member 56 and the second working member 58. The predetermined feature 28 has a first predetermined end and a second predetermined end opposite to each other. At least one of the first predetermined end and the second predetermined end is arranged with a guiding feature. In the present embodiment, the first predetermined end and the second predetermined end are arranged with a first guiding feature 29*a* and a second guiding feature 29*b* respectively, and the first guiding feature 29*a* and the second guiding feature 29*b* can be inclined surfaces or arc surfaces.

Figure 6:
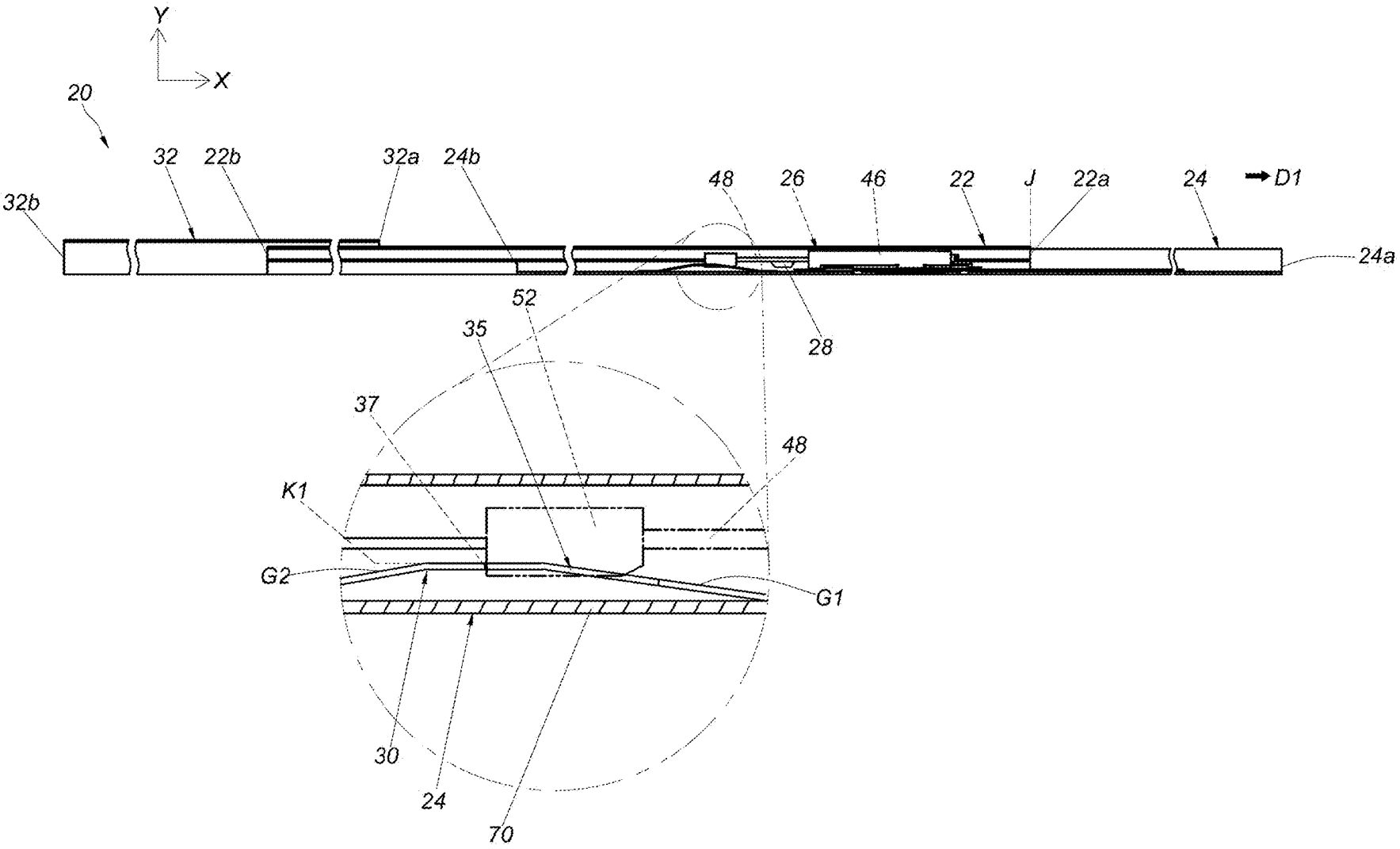
FIG. 6 is a diagram showing the first rail located at an opening position relative to the third rail with the second rail being moved relative to the first rail along a first direction according to the embodiment of the present invention.
Figure 7:
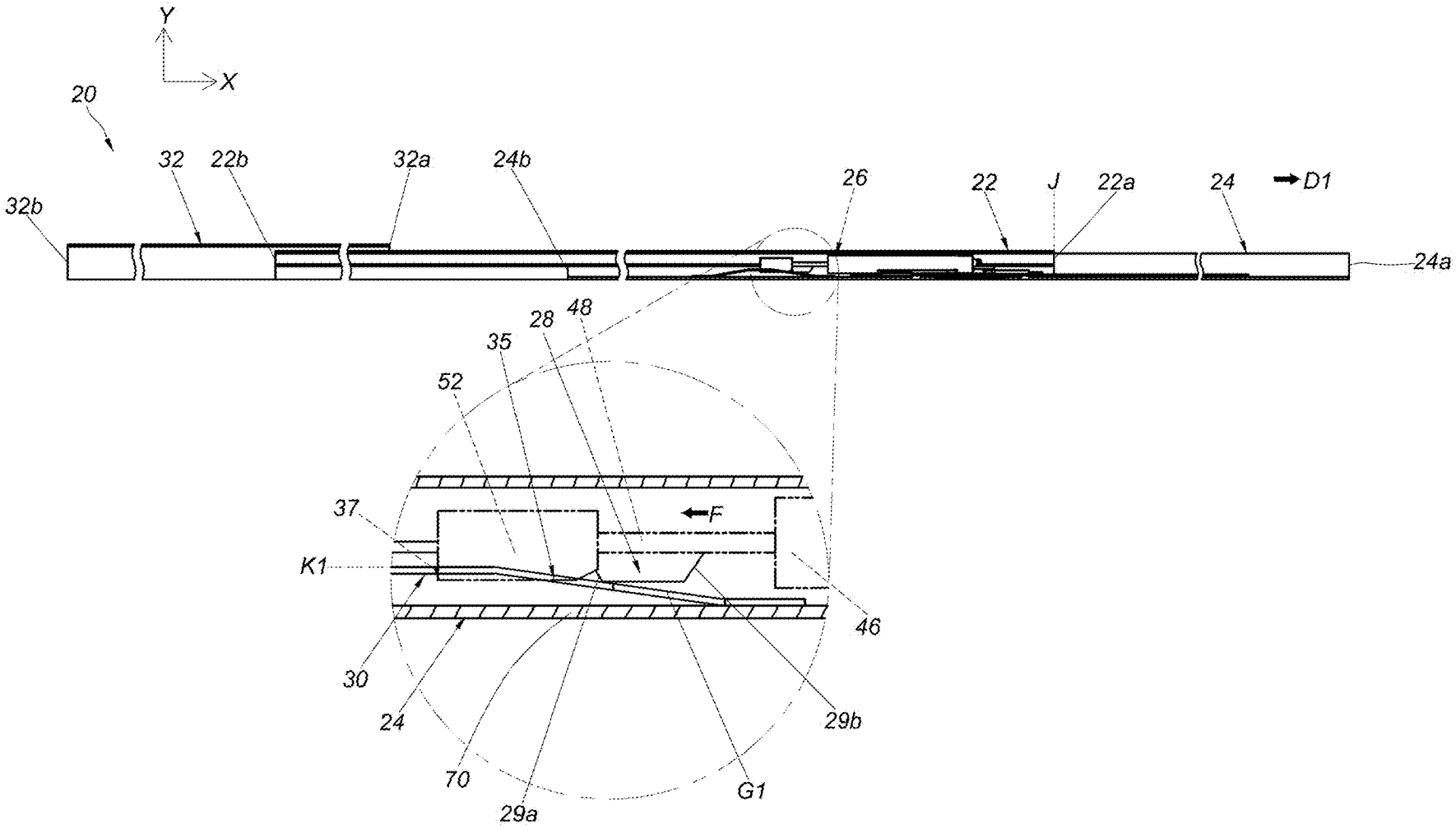
FIG. 7 is a diagram showing the first rail located at the opening position relative to the third rail with the second rail being further moved relative to the first rail along the first direction according to the embodiment of the present invention.

As shown in FIG. 5 to FIG. 7, during a process of the second rail 24 being moved relative to the first rail 22 from the retracted position R (as shown in FIG. 5) along a first direction D1 (such as an opening direction), the auxiliary member 30 is configured to drive the damping device 26. Specifically, the auxiliary member 30 in the first predetermined state K1 is configured to abut against the damping device 26 (as shown in FIG. 6) to drive the damping device 26 to provide damping effect F (as shown in FIG. 7), such as providing damping effect F to the second rail 24.

Furthermore, when the first rail 22 is located at an opening position J relative to the third rail 32, the first end part 22*a* of the first rail 22 is extended beyond the first end part 32*a* of the third rail 32, and the first rail 22 is configured to be locked at the opening position J relative to the third rail 32. Such configuration is well known to those skilled in the art, no further illustration is provided for simplicity. During a process of the second rail 24 being moved along the first direction D1 relative to the first rail 22 located at the opening position J, the predetermined wall 37 of the auxiliary member 30 in the first predetermined state K1 is configured to abut against the actuating member 52 (as shown in FIG. 6) on the second damping part 48 to retract the second damping part 48 relative to the first damping part 46, so as to drive the damping device 26 to provide the damping effect F (as shown in FIG. 7).

Figure 8:
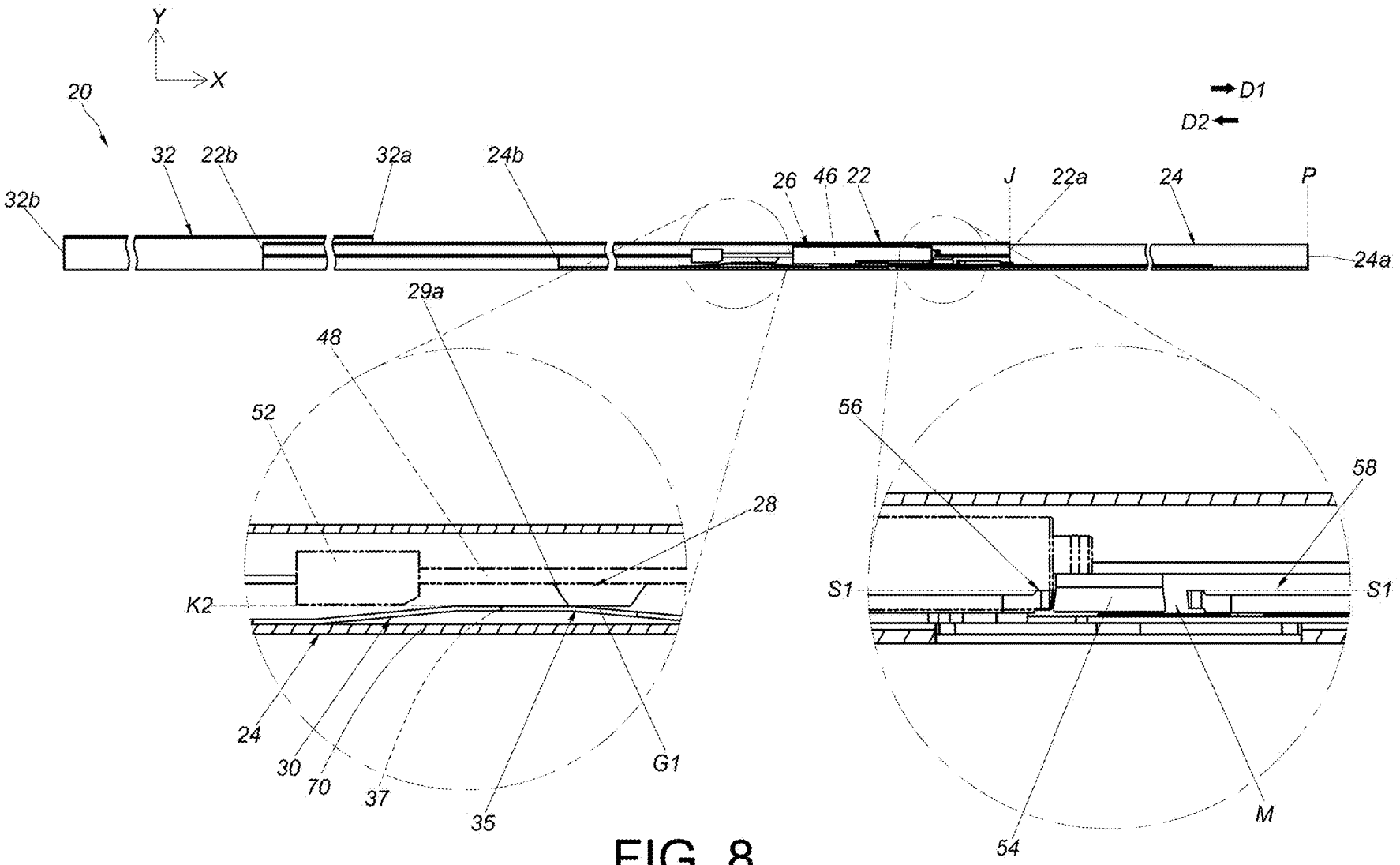
FIG. 8 is a diagram showing the first rail located at the opening position relative to the third rail with the second rail being locked at a predetermined position relative to the first rail according to the embodiment of the present invention.

As shown in FIG. 8, when the second rail 24 is further moved along the first direction D1 relative to the first rail 22, the predetermined feature 28 (such as the first guiding feature 29*a* of the predetermined feature 28) is configured to abut against the auxiliary member 30 (such as the first guiding section G1 of the auxiliary member 30) in order to drive the auxiliary member 30 to switch from the first predetermined state K1 to a second predetermined state K2. For example, the auxiliary member 30 is elastically deformed, such that the actuating member 52 on the second damping part 48 of the damping device 26 no longer blocks a moving path of the predetermined wall 37 of the auxiliary member 30, so as to detach the predetermined wall 37 of the auxiliary member 30 from the actuating member 52 on the second damping part 48 of the damping device 26. In other words, the auxiliary member 30 no longer drives the damping device 26, such that the damping device 26 no longer provides the damping effect F to the second rail 24. Meanwhile, the second damping part 48 is extended relative to the first damping part 46 again.

Figure 9:
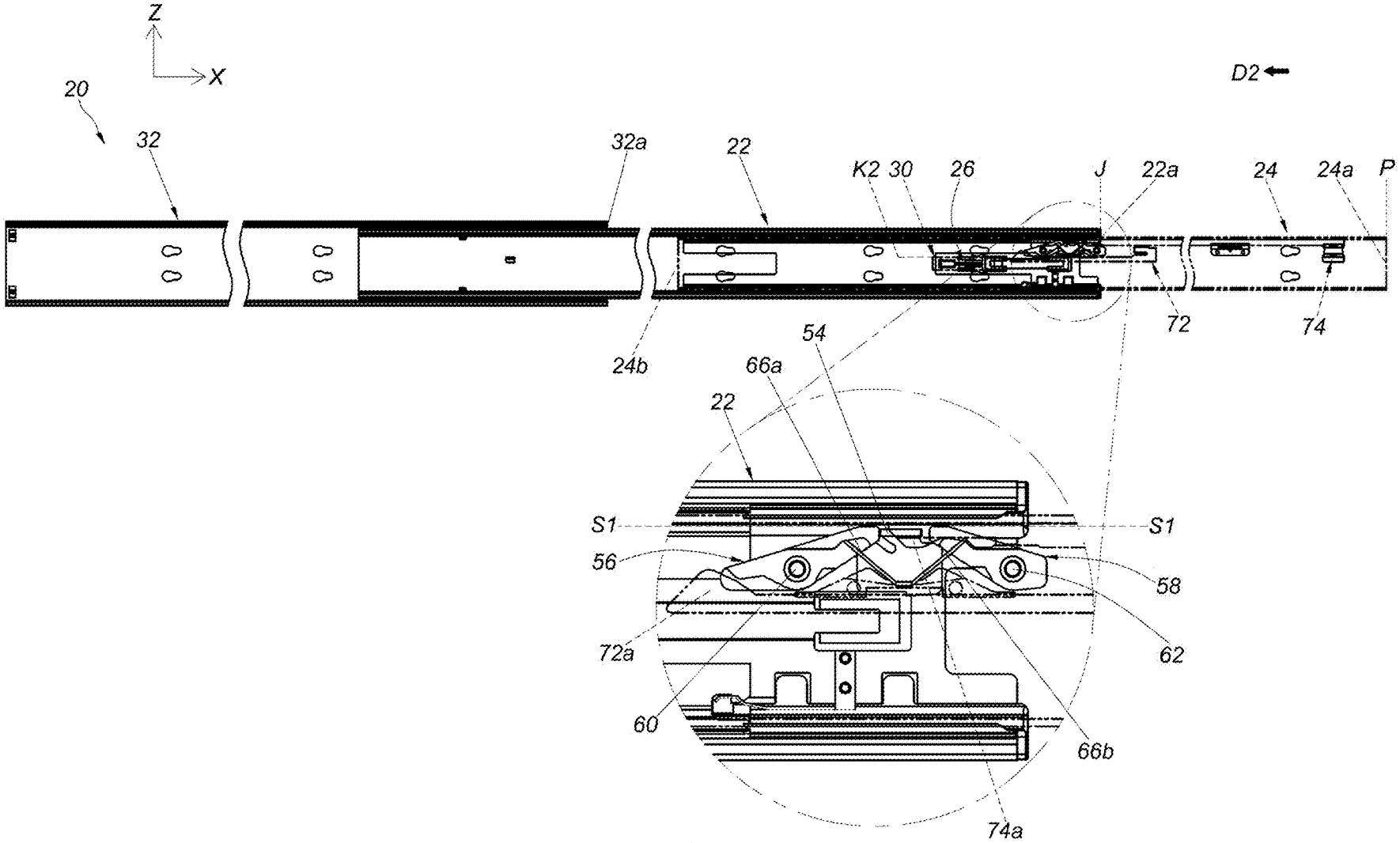
FIG. 9 is a diagram showing the first rail located at the opening position relative to the third rail with the second rail being locked at the predetermined position relative to the first rail in another viewing angle according to the embodiment of the present invention.

As shown in FIG. 8 and FIG. 9, when the second rail 24 is further moved along the first direction D1 relative to the first rail 22 to a predetermined position P (such as an extended position), the first and second working members 56, 58 in a first working state S1 are configured to be located adjacent to a rear end and a front end of the blocking part 54 respectively in order to block the blocking part 54, and the blocking part 54 is accommodated in the auxiliary space M in order to prevent the second rail 24 from being moved away from the predetermined position P. For example, the second rail 24 is prevented from being moved away from the predetermined position P along the first direction D1 or a second direction D2 (such as a retracting direction). When the second rail 24 is located at the predetermined position P relative to the first rail 22, the first end part 24*a* of the second rail 24 is extended beyond the first end part 22*a* of the first rail 22. As such, the slide rail assembly 20 is in an extended state. Such configuration is well known to those skilled in the art, no further illustration is provided for simplicity.

Figure 10:
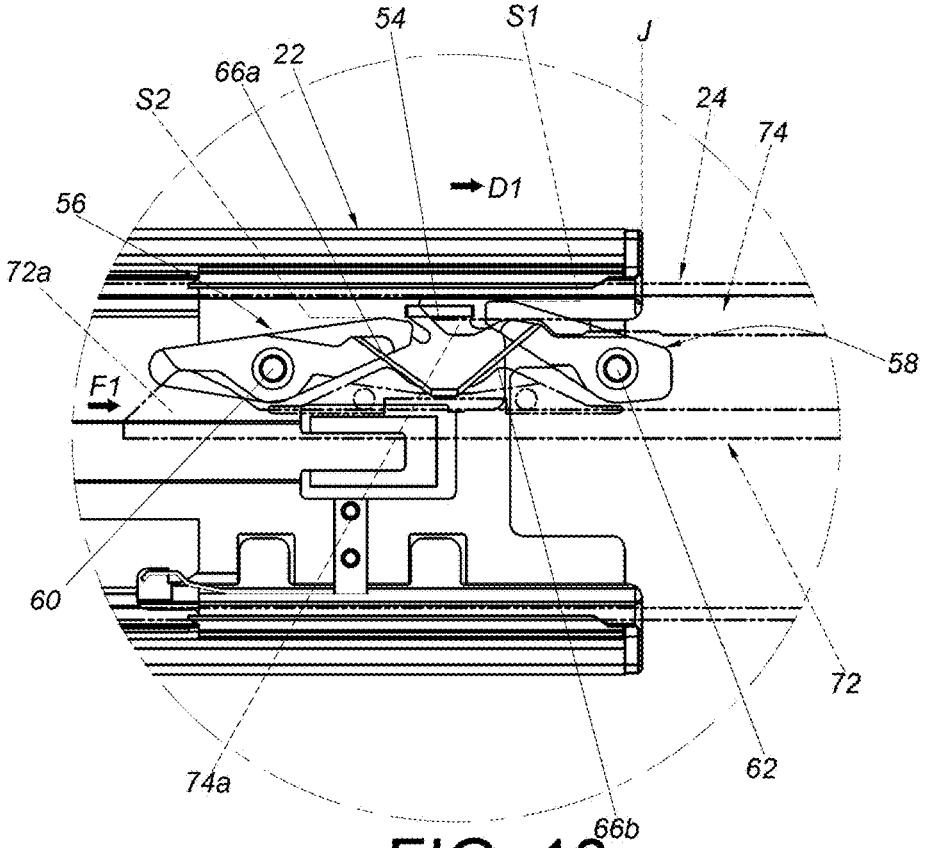
FIG. 10 is a diagram showing the second rail located at the predetermined position relative to the first rail with a first working member being driven to allow the second rail to move away from the predetermined position along the first direction according to the embodiment of the present invention.

As shown in FIG. 9 and FIG. 10, when the second rail 24 is located at the predetermined position P relative to the first rail 22 and when a user applies a first force F1 to the first operating member 72, a first driving part 72*a* of the first operating member 72 is configured to drive the first working member 56 to move (ex. rotate) to switch from the first working state S1 (as shown in FIG. 9) to a second working state S2 (as shown in FIG. 10), such that the first working member 56 and the rear end of the blocking part 54 no longer block each other, in order to allow the second rail 24 to be moved away from the predetermined position P along the first direction D1.

Figure 11:
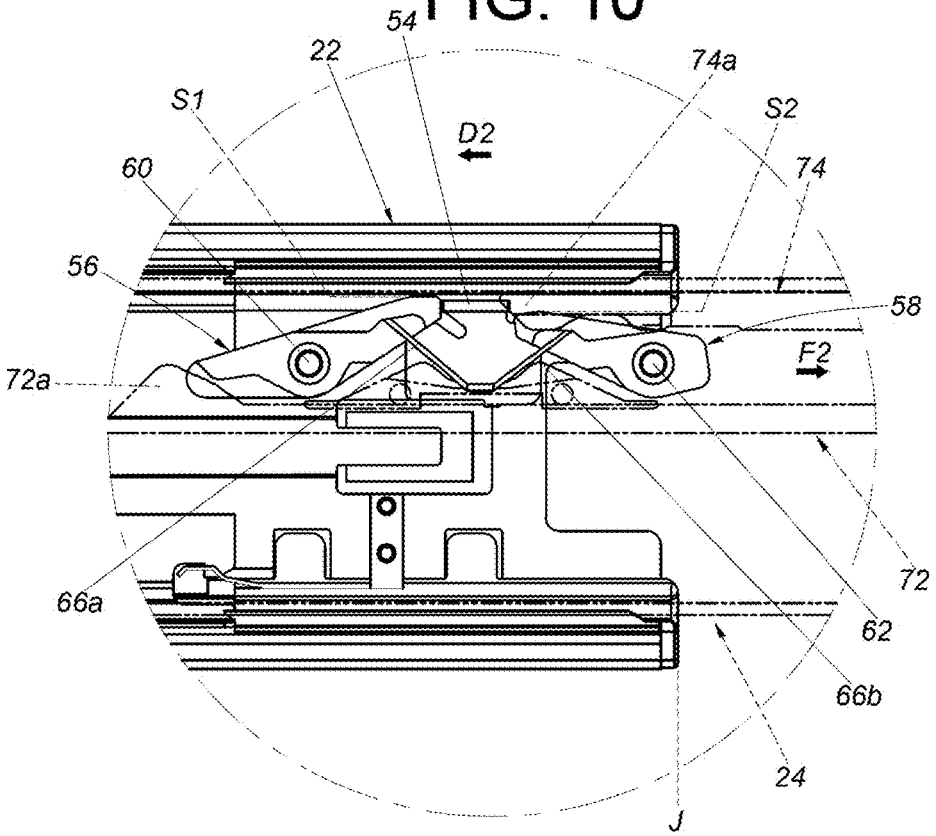
FIG. 11 is a diagram showing the second rail located at the predetermined position relative to the first rail with a second working member being driven to allow the second rail to move away from the predetermined position along a second direction according to the embodiment of the present invention.

As shown in FIG. 9 and FIG. 11, when the second rail 24 is located at the predetermined position P relative to the first rail 22 and when the user applies a second force F2 to the first operating member 72, a second driving part 74*a* of the second operating member 74 is configured to drive the second working member 58 to move (ex. rotate) to switch from the first working state S1 (as shown in FIG. 9) to the second working state S2 (as shown in FIG. 11), such that the second working member 58 and the front end of the blocking part 54 no longer block each other, in order to allow the second rail 24 to be moved away from the predetermined position P along the second direction D2. Moreover, since the damping device 26 no longer provides the damping effect F to the second rail 24, the second working member 58 in the first working state S1 is prevented from tightly contacting the front end of the blocking part 54, such that the second working member 58 can be easily driven to move to switch from the first working state S1 to the second working state S2.

Therefore, the slide rail assembly according to the embodiment of the present invention has the following technical features:

1. When the user moves the second rail 24 along the first direction D1 relative to the first rail 22 to be close to the predetermined position P, the auxiliary member 30 is configured to abut against the damping device 26 to provide the damping effect to the second rail 24. As such, the user can notice that the second rail 24 is about to reach the predetermined position P. Moreover, impact before the second rail 24 reaches the predetermined position P can be reduced.

2. When the second rail 24 is moved relative to the first rail 22 along the first direction D1 to be close to the predetermined position P, the damping effect F of the damping device 26 has been provided. When the second rail 24 is further moved relative to the first rail 22 along the first direction D1 to reach the predetermined position P, the damping device 26 no longer provides the damping effect F to the second rail 24. As such, it can be prevented that one of the first work member 56 and the second working member 58 in the first working state S1 is in close contact with the blocking part 54 to hardly drive the first working member 56 or the second working member 58 to move.

3. The damping device 26 is arranged adjacent to the first end part 22*a* of the first rail 22. When the second rail 24 is moved along the first direction D1, the damping device 26 is directly driven by the auxiliary member 30 to provide the damping effect F. In contrast to the prior art, the damping effect in the embodiment of the present invention is more direct and obvious.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A slide rail assembly, comprising:

a first rail arranged with a predetermined feature;

a second rail movable relative to the first rail;

a damping device arranged on the first rail; and an auxiliary member arranged on the second rail, wherein the auxiliary member is configured to switch between a first predetermined state and a second predetermined state relative to the second rail;

wherein during a process of the second rail being moved relative to the first rail along a first direction, the auxiliary member in the first predetermined state is configured to abut against the damping device, such that the damping device provides damping effect to the second rail; and wherein when the second rail is further moved relative to the first rail along the first direction, the predetermined feature is configured to abut against the auxiliary member to drive the auxiliary member to switch from the first predetermined state to the second predetermined state in order to detach the auxiliary member from the damping device, such that the damping device no longer provides damping effect to the second rail.

2. The slide rail assembly of claim 1, further comprising a third rail, wherein the first rail is movably mounted between the third rail and the second rail.

3. The slide rail assembly of claim 1, wherein the first rail has a first end part and a second end part opposite to each other, the damping device is arranged adjacent to the first end part of the first rail.

4. The slide rail assembly of claim 1, wherein the first rail is further arranged with a blocking part, and the slide rail assembly further comprises a first working member and a second working member movably mounted on the second rail; wherein when the second rail is further moved relative to the first rail along the first direction to a predetermined position, the first working member and the second working member are configured to be located adjacent to two opposite ends of the blocking part respectively in order to prevent the second rail from being moved away from the predetermined position.

5. The slide rail assembly of claim 4, wherein the first working member and the second working member are pivoted to the second rail, and the second rail is arranged with a first elastic part and a second elastic part configured to provide elastic forces to the first working member and the second working member respectively.

6. The slide rail assembly of claim 5, further comprising at least one operating member configured to drive the first working member and the second working member to move.

7. The slide rail assembly of claim 1, wherein the predetermined feature is a protruded part.

8. The slide rail assembly of claim 7, wherein the predetermined feature has a first predetermined end and a second predetermined end.

9. The slide rail assembly of claim 8, wherein at least one of the first predetermined end and the second predetermined end is arranged with a guiding feature.

10. The slide rail assembly of claim 1, wherein the damping device comprises a first damping part and a second damping part movable relative to each other.

11. A slide rail assembly, comprising:

a first rail;

a second rail movable relative to the first rail;

a damping device and a predetermined feature arranged on one of the first rail and the second rail; and an auxiliary member arranged on the other one of the first rail and the second rail, wherein the auxiliary member is an elastic component;

wherein during a process of the second rail being moved relative to the first rail along an opening direction, the auxiliary member is configured to abut against the damping device to drive the damping device to provide damping effect; and wherein when the second rail is further moved relative to the first rail along the opening direction, the predetermined feature is configured to abut against the auxiliary member to elastically deform the auxiliary member to be detached from the damping device to no longer drive the damping device to provide damping effect.

12. The slide rail assembly of claim 11, further comprising a third rail, wherein the first rail is movably mounted between the third rail and the second rail; wherein the third rail is an outer rail, the first rail is a middle rail, and the second rail is an inner rail.

13. The slide rail assembly of claim 11, wherein the first rail has a first end part and a second end part opposite to each other, the damping device is arranged adjacent to the first end part of the first rail.

14. The slide rail assembly of claim 11, wherein the first rail is further arranged with a blocking part, and the slide rail assembly further comprises a first working member movably mounted on the second rail; wherein when the second rail is further moved relative to the first rail along the opening direction to a predetermined position, the first working member is configured to be located adjacent to the blocking part in order to prevent the second rail from being moved away from the predetermined position along the opening direction.

15. The slide rail assembly of claim 14, wherein the first working member is pivoted to the second rail, and the second rail is arranged with a first elastic part configured to provide an elastic force to the first working member.

16. The slide rail assembly of claim 15, further comprising an operating member configured to drive the first working member to move.

17. The slide rail assembly of claim 11, wherein the predetermined feature is a protruded part.

18. The slide rail assembly of claim 17, wherein the predetermined feature has a first predetermined end and a second predetermined end.

19. The slide rail assembly of claim 18, wherein at least one of the first predetermined end and the second predetermined end is arranged with a guiding feature.

20. The slide rail assembly of claim 11, wherein the damping device comprises a first damping part and a second damping part movable relative to each other.

* * * * *